US008388413B1

(12) United States Patent
Dovel et al.

(10) Patent No.: US 8,388,413 B1
(45) Date of Patent: Mar. 5, 2013

(54) WIDEBLADE SHARPENING GUIDE

(75) Inventors: Daniel T. Dovel, Shady Cove, OR (US); Christopher T. DeLorenzo, Ashland, OR (US)

(73) Assignee: Darex, LLC, Ashland, OR (US)

( * ) Notice: Subject to any disclaimer, the term of this patent is extended or adjusted under 35 U.S.C. 154(b) by 529 days.

(21) Appl. No.: 12/563,886

(22) Filed: Sep. 21, 2009

Related U.S. Application Data

(60) Provisional application No. 61/098,573, filed on Sep. 19, 2008.

(51) Int. Cl.
*B24B 1/00* (2006.01)
*B24B 19/00* (2006.01)

(52) U.S. Cl. ..... 451/45; 451/371

(58) Field of Classification Search ..... 451/48, 451/44, 45, 371, 193, 367, 380, 555, 365, 451/386, 391, 234, 278, 293, 404, 405, 419
See application file for complete search history.

(56) References Cited

U.S. PATENT DOCUMENTS

| | | | | |
|---|---|---|---|---|
| 4,733,501 | A | 3/1988 | McLean | |
| 5,582,542 | A * | 12/1996 | Stein | 451/367 |
| 7,281,969 | B2 * | 10/2007 | Naples et al. | 451/371 |
| 7,335,093 | B1 * | 2/2008 | Stanley | 451/367 |
| 7,553,216 | B2 * | 6/2009 | Hyde et al. | 451/45 |
| 2006/0189263 | A1 * | 8/2006 | Evans | 451/45 |
| 2007/0281594 | A1 | 12/2007 | Jones et al. | |
| 2008/0113591 | A1 * | 5/2008 | Stanley | 451/45 |

* cited by examiner

*Primary Examiner* — Dung Van Nguyen
(74) *Attorney, Agent, or Firm* — Hall Estill Attorneys at Law

(57) ABSTRACT

Apparatus and method for sharpening a tool, such as a chisel. A sharpening guide applies a clamping force to secure the tool and advances a beveled leading edge surface of the secured tool against an abrasive surface to sharpen a cutting edge while the guide is in an upright orientation. An alignment plate nestingly receives the guide in an inverted orientation to align the tool prior to sharpening. During alignment, a back surface of the tool slidingly contacts an upper plate surface and the cutting edge contactingly abuts an alignment feature which projects from the plate surface. In some embodiments, the alignment feature comprises a removable alignment pin selectively insertable into a plurality of spaced apart apertures, each providing a final bevel angle for the sharpened tool.

29 Claims, 9 Drawing Sheets

WIDEBLADE SHARPENING GUIDE

RELATED APPLICATIONS

This application makes a claim of domestic priority to U.S. Provisional Application No. 61/098,573 filed Sep. 19, 2008.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces that intersect along a line that lies along the cutting edge.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, etc. A limitation with these and other prior art sharpening techniques is the inability to precisely define the opposing surfaces at the desired angles to provide a precisely defined cutting edge.

SUMMARY

Various embodiments of the present invention are generally directed to an apparatus and method for sharpening a tool, such as a chisel.

In accordance with various embodiments, a sharpening guide has opposing first and second body portions which are configured to contactingly apply a clamping force to respective side surfaces of a tool to secure the tool to the guide. The guide is configured to present a beveled leading edge surface of the secured tool adjacent an abrasive surface to sharpen a cutting edge of the tool while the guide is in an upright orientation. The guide is further configured to present a back side of the secured tool against the abrasive surface to hone a portion of the back surface disposed between the first and second body portions while the guide is in an inverted orientation opposite the upright orientation.

In further embodiments, an alignment plate is configured to align the tool within the guide prior to application of said clamping force. The plate is configured to nestingly secure the guide to the plate while the guide is placed in the inverted orientation, and the tool is advanced through the inverted guide so that the back surface slides adjacent an upper plate surface and the cutting edge contactingly abuts an alignment feature which projects from the plate surface. The guide and the plate are further configured such that the clamping force is subsequently applied while said contacting abutment between the cutting edge and the alignment feature is maintained.

In further embodiments, the alignment plate comprises a plurality of spaced apart apertures which extend into the upper plate surface, wherein the alignment feature comprises an alignment pin with a body portion and a peg extension, the peg extension configured for insertion into each of the apertures in turn to establish different overall projection distances of the beveled leading edge surface from the guide to provide different final bevel angles for the sharpened tool. As desired, the body portion of the alignment pin comprises at least two opposing, outwardly facing contact surfaces each a different respective distance from a central axis of the peg extension to provide at least two different selectable bevel angles for the sharpened tool when the alignment pin is placed in each of the apertures in the alignment plate.

In still further embodiments, the first and second body portions each comprise a long side surface of a first length and a short side surface of a second length shorter than the first length. In this way, a selected tool can be alternately installed between the first and second body portions so that a cutting surface thereof extends from the guide adjacent the respective long side surfaces or the respective short side surfaces.

Various other features and advantages of the various embodiments of the present invention will be understood from a review of the following detailed description and associated drawings.

DETAILED DESCRIPTION

The present disclosure is generally directed to improvements in the manner in which tools are sharpened, such as chisel-type tools having an elongated cutting edge. One problem associated with the prior art is the difficulty in presenting a tool at a desired geometry against an abrasive surface in an accurate and repeatable manner.

As discussed below, various embodiments of the present invention are generally directed to an apparatus and method for sharpening a tool. The various embodiments generally employ a sharpening guide which is used to advance the tool against an abrasive surface during a sharpening operation. The sharpening guide includes notches that facilitate honing of a back surface of the tool along an area disposed between respective body portions used to clamp respective sides of the tool.

In further embodiments, an alignment plate facilitates alignment of the tool within the guide prior to the sharpening operation. The guide and plate cooperate to provide accurate and repeatable sharpening geometries in a fast and easy to use manner.

Figure 1:
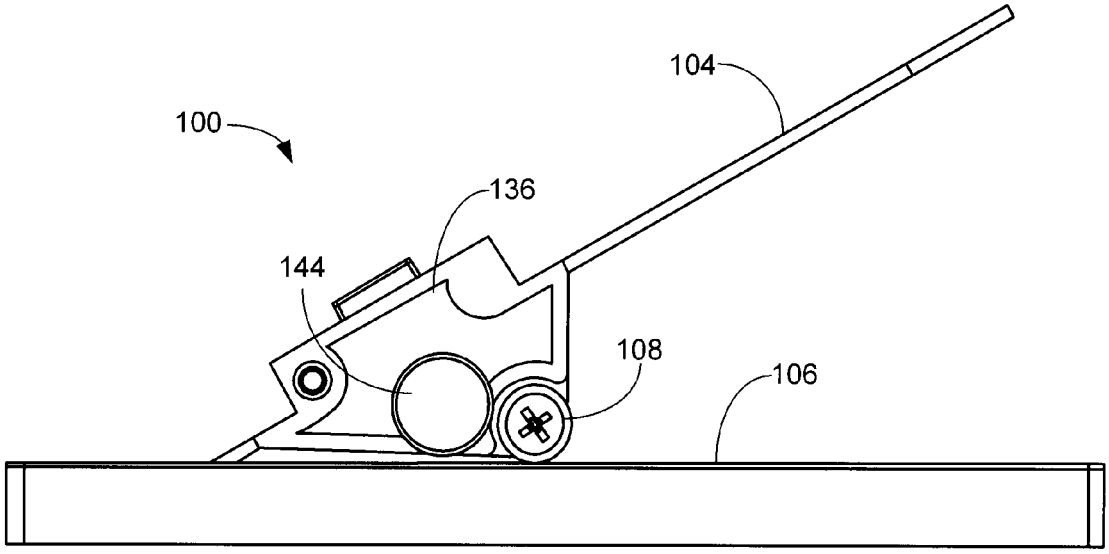
FIG. 1 is a side elevational depiction of a wideblade sharpening guide constructed in accordance with various embodiments of the present invention.

FIG. 1 shows an exemplary wideblade sharpening guide 100. The sharpening guide 100 facilitates the sharpening of a variety of cutting tools, including chisel-style tools such as shown at 102 and 104 in FIG. 2. The term "wideblade" generally denotes the ability to accommodate laterally extending tools of various widths, so that both extremely narrow and extremely wide tools can be respectively sharpened using the exemplary guide 100. This is merely illustrative, however, and not limiting to the claimed subject matter.

The guide 100 is configured to support a selected tool, such as the tool 104, at a selected angle and projection distance to enable sharpening of the tool against an abrasive surface 106. The surface 106 can be stationary, in which case the guide 100 can be reciprocatingly advanced and retracted on the surface 106 via wheels 108. Alternatively, the surface 106 can be moveable, such as in the case of a moving belt or rotating wheel (disc), in which case the guide 100 can be reciprocatingly advanced and retracted adjacent the moving surface. The orientation of the guide in FIG. 1 will be referred to herein as an upright orientation.

Figure 2:
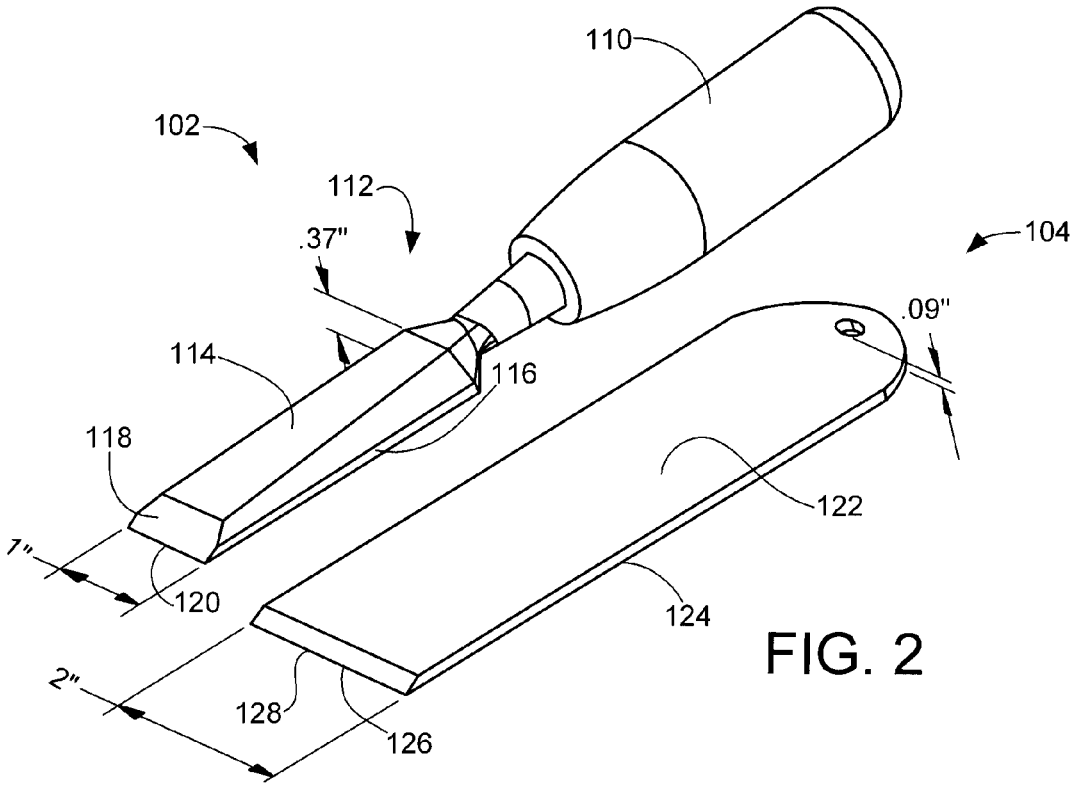
FIG. 2 illustrates various exemplary types of tools that can be sharpened using the guide of FIG. 1.

The tool 102 in FIG. 2 is characterized as a chisel with a user handle 110 and a blade portion 112. The blade portion 112 includes opposing top and bottom surfaces, with the top surface denoted at 114 and the bottom surface (back surface) not visible in FIG. 2. The blade portion 112 has opposing edge surfaces, with one edge surface identified at 116 and the other edge surface not visible in FIG. 2. A beveled leading edge surface 118 extends from the respective top and edge surfaces to meet with the bottom surface along a cutting edge 120. The leading edge surface 118 extends at a selected bevel angle, such as 25 degrees, although other bevel angles can be readily used.

The tool 104 is characterized as a plane (or plane iron) with a single piece, elongated construction. As with the chisel 102, the plane 104 has opposing top and bottom (back) surfaces, edge surfaces and beveled leading edge surface. The top surface is denoted at 122, one of the edge surfaces is denoted at 124, and the beveled leading edge surface is denoted at 126. The beveled surface 126 extends at an acute angle with the back surface (such as 25 degrees) to form a cutting edge 128.

Figure 3:
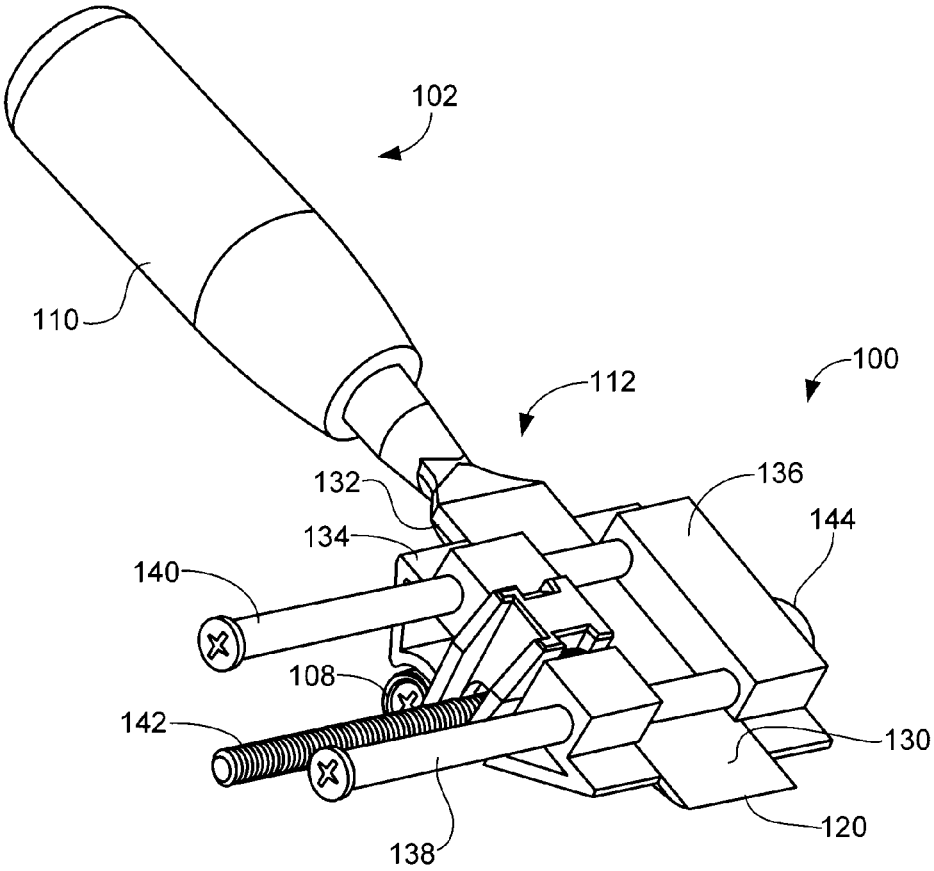
FIG. 3 is an isometric view of the guide of FIG. 1 in conjunction with a selected tool from FIG. 2.
Figure 4:
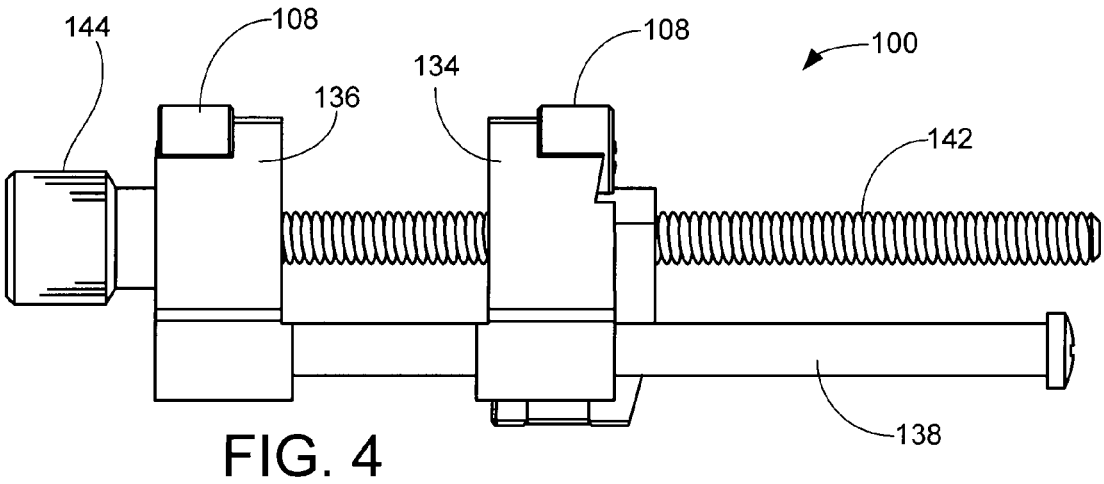
FIG. 4 is an end elevational view of the guide of FIGS. 1 and 3.

FIG. 3 shows the chisel 102 of FIG. 2 installed onto the guide 100 of FIG. 1, and reveals the aforementioned bottom (back) surface 130 of the chisel 102. The side of the chisel 102 opposite the side 116 is not visible in FIG. 2, but is denoted at 132. FIG. 4 shows a side elevational view of the sharpening guide 100 in a stand alone fashion without the cutting tools 102, 104.

As set forth by FIGS. 3 and 4, the guide 100 includes opposing body portions 134, 136 which act as a vice to apply a clamping force to a selected tool on the respective edge surfaces such as 116, 132 of chisel 102. A pair of rails 138, 140 facilitates sliding passage of the body portion 134 with respect to the body portion 136. A worm gear is established by a threaded shaft 142 with user activated knob 144.

The rails 138, 140 provide reference surfaces in that the back surface of the tool (e.g., surface 130) is maintained in contacting engagement with the rails 138, 140 when the tool is installed into the guide 100. The guide 100 is configured to project the leading edge surface (e.g. 118, 126) of the tool at an appropriate angle for sharpening against the abrasive surface 106. The tool further extends from the guide 100 a sufficient distance to facilitate a honing operation upon the bottom surface (e.g., 130) against the abrasive surface when the guide 100 is inverted.

Figure 5:
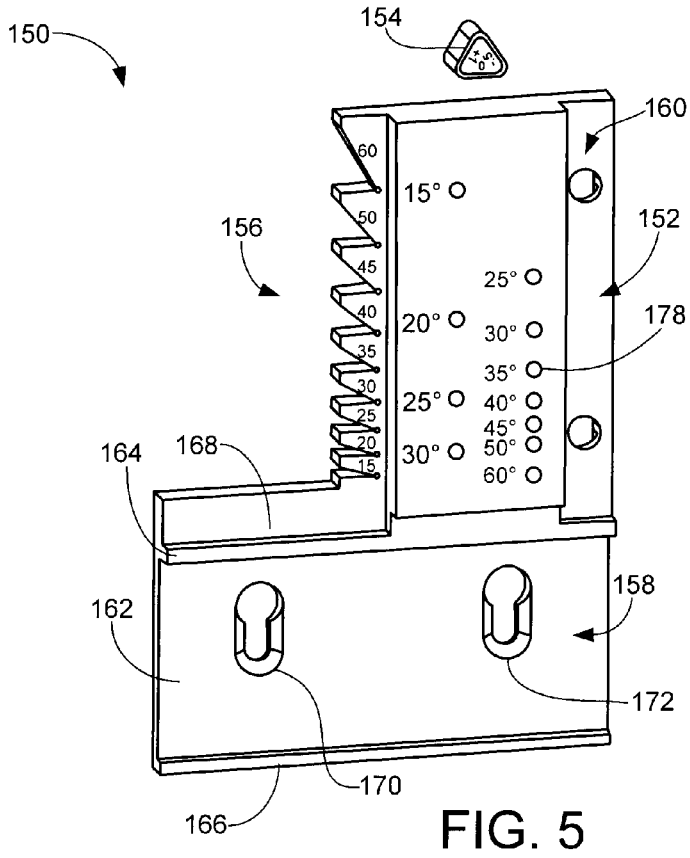
FIG. 5 generally illustrates an alignment assembly utilized in accordance with various embodiments to install a selected tool into the guide.

FIG. 5 shows an alignment assembly 150 used to install a selected tool onto the guide 100. The alignment assembly 150 includes an alignment plate 152 and a removable alignment pin 154. The plate 152 is preferably L-shaped as shown, although other configurations can readily be utilized as desired.

The alignment plate 152 nestingly secures the guide 100 while the guide is disposed in an inverted orientation. It will be appreciated that the inverted orientation is opposite the normal upright orientation used during sharpening of the leading beveled edge of the tool.

Figure 5A:
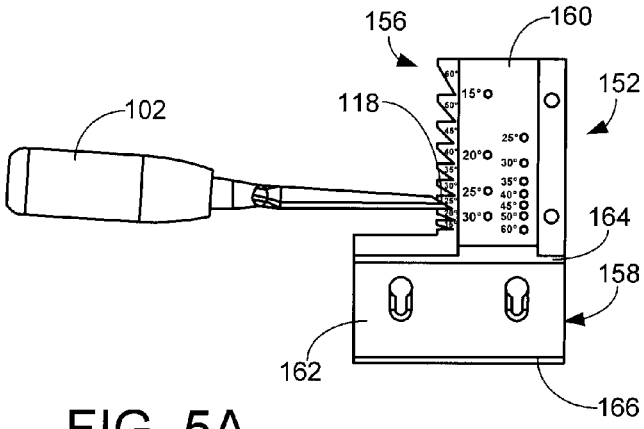
FIGS. 5A-5B respectively show a preferred use of angle finder and perpendicularity features of the alignment assembly of FIG. 5.

An array of slots 156 extends along one side of the plate 152 to serve as an angle finder to identify an existing angle of a given tool. For example, FIG. 5A shows insertion of the beveled leading edge 120 of the tool 102 into the slot 156 corresponding to an angle of 25 degrees, thereby identifying the angle of the beveled leading edge 118 as nominally corresponding to this value. Human readable indicia (15, 20, 25, etc.) are provided adjacent the corresponding slots 156 to identify the corresponding angular values. The indicia can be printed, molded, stamped, etc. as desired.

The angle finder capability provided by the slots 156 can be helpful when the particular angle of a given tool is initially unknown, and the user desires to maintain the tool with this same nominal angle. It will be appreciated, however, that the guide 100 can be used to provide a different final angle for the leading edge of the tool; for example, the user may desire to reshape a tool with an initial angle (e.g., 25 degrees, etc.) to a different final angle (e.g., 30 degrees, etc.). In such cases, the angle finder capability need not be utilized.

Continuing with FIG. 5, the plate 152 further includes a base portion 158 configured to matingly receive the inverted guide 100, and an extension portion 160 configured to set an outermost distal extent of the tool during alignment. The base portion includes a base surface 162 and opposing, laterally extending lip flanges 164, 166 which nestingly receive the body portions 134, 136 of the guide 100, as shown below.

Figure 5B:
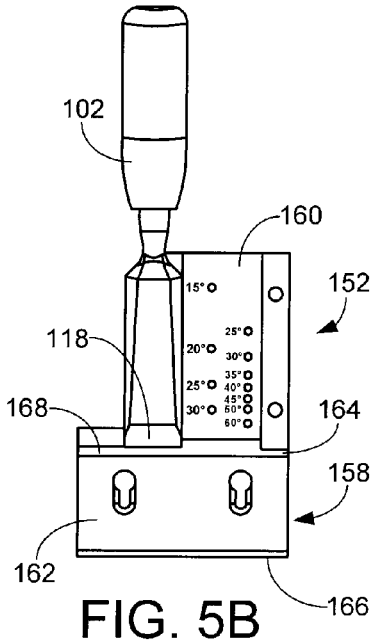

The flange 164 further provides a reference surface 168 which can be utilized as shown in FIG. 5B to evaluate perpendicularity of the cutting edge 120 of the tool 102 prior to installation. A pair of elongated mounting apertures 170, 172 extends through the base portion 158 to facilitate hanging storage of the plate 152 when not in use, and/or to facilitate the mounting of the plate 152 to a suitable horizontal work surface during use.

Figure 6:
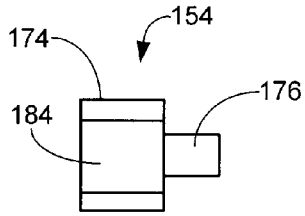
FIG. 6 is a side elevational view of an alignment pin of the alignment assembly of FIG. 5.

The alignment pin 154 is shown in FIG. 6 to include a substantially triangular body portion 174 and a cylindrical shaft, or peg 176. The peg 176 is sized to be selectively placed in a number of different annular apertures 178 in the extension portion 160 of the plate 152 (see FIG. 5). As with the angle finder slots 156, human readable indicia (15°, 20°, 25°, etc.) are provisioned adjacent the respective apertures 178. It will be appreciated that the apertures 178 for smaller bevel angles are located increasingly farther away from the base portion 158, whereas the apertures 178 for larger bevel angles are located increasingly closer to the base portion 158.

Figure 7:
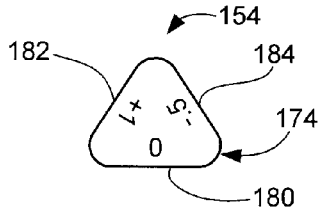
FIG. 7 shows a corresponding top plan view of the alignment pin.

FIG. 7 shows a top plan view of the alignment pin 154. In some embodiments, the alignment pin has three opposing abutment surfaces 180, 182 and 184, marked with corresponding indicia of 0, +1 and −0.5. The relative shapes and/or placement of the peg 176 therewith are selected such that controlled deviations from a base bevel angle can be achieved. More specifically, when the alignment pin 154 is placed into a corresponding aperture 178 in the extension portion 160, the user has the option of placing any one of the three abutment surfaces 180 (0), 182 (+1) or 184 (−0.5) in facing relation to the base portion 158 so that the tool abuts that selected surface.

For example, when the alignment pin 154 is placed in the 25° aperture so that the surface 180 is in the aforedescribed facing relation, the tool will be set to provide a finished bevel angle of nominally 25°. Use of the surface 182 will nominally provide a finished bevel angle of 25+1=26°, whereas use of the surface 184 will nominally provide a finished bevel angle of 25−0.5=24.5°. Such adjustability can be advantageous in certain situations, such as to compensate for angular drift over a succession of sharpening operations on a given tool.

Figure 8:
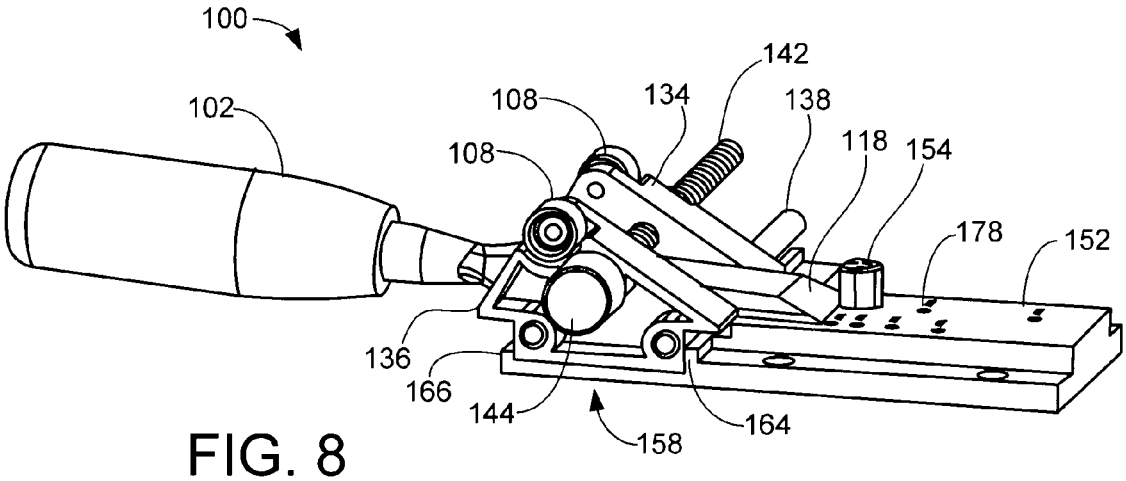
FIG. 8 is an isometric view of the guide and alignment assembly.

FIG. 8 shows a preferred manner in which a selected tool, in this case the chisel 102, is installed onto the guide 100 using the alignment assembly 150. The alignment pin 154 shown to be installed in the aperture 178 of the plate 152 corresponding to a bevel angle of 25°.

Initially, the user loosens the user activated knob 144 to separate the respective body portions 134, 136 of the guide 100 to permit sliding passage of the blade portion 112 of the tool 102 therebetween. The user next places both the guide 100 and the tool 102 onto the plate 152 so that the body portions 134, 136 nest onto the base portion 158 of the plate, and the tool 102 rests upon the respective rails 138, 140. The user next advances the tool through the guide 100 and along the rails 138, 140 until the beveled leading edge 118 comes into contacting abutment against the alignment pin 154.

Figure 9:
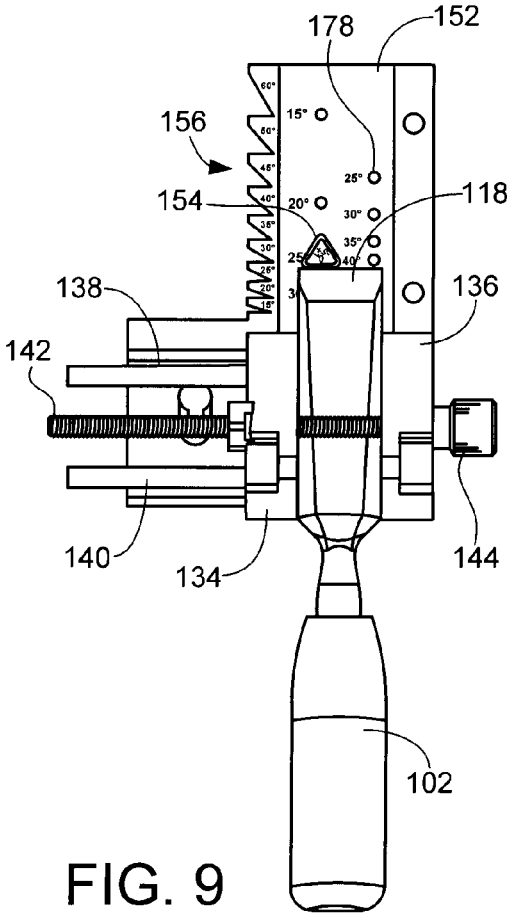
FIGS. 9 and 10 show top plan views of the guide and alignment assembly.
Figure 10:
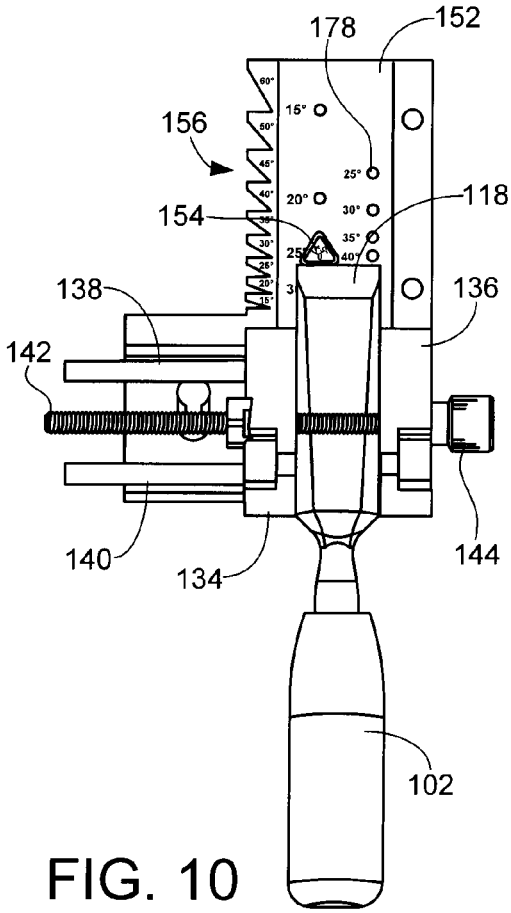

At this point, while maintaining contact of the tool against both rails 138, 140 and against the alignment pin 154, the user tightens the knob 144 so as to establish a clamping force upon the tool 102 and maintain the tool in this position via the respective body portions 134, 136. Respective top plan views of this operation are generally shown in FIGS. 9 and 10. In FIG. 9, the alignment pin 154 is set so as to provide abutment against the 0 degree surface 180, whereas in FIG. 10 the alignment pin 154 is set so as to provide abutment against the +1 degree surface 182. It will be noted that the alignment pin 154 may rotate so as to ensure parallel alignment of the facing surface with the presented beveled leading edge.

Figure 11:
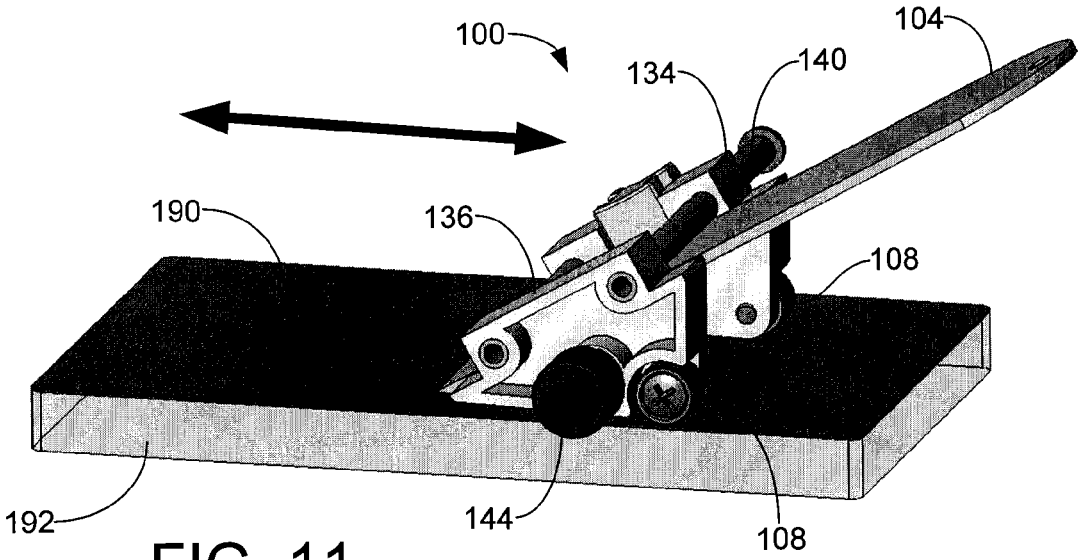
FIG. 11 shows a methodology for sharpening a leading edge of a selected tool on a stationary abrasive surface.

Once the tool has been installed onto the sharpening guide 100, the guide and tool are removed from the alignment plate 152, and the beveled leading edge 118 is thereafter presented against a suitable abrasive surface for sharpening thereagainst. FIG. 11 shows installation of the cutting tool 104 onto the sharpening guide 100 and reciprocal movement of the sharpening guide 100 and cutting tool 104 along a stationary abrasive surface 190, such as a layer of sandpaper or similar media adhered to a glass block 192 or other suitable substrate. As noted previously, controlled forward and backward motion can be achieved by the user grasping the tool and/or the guide 100 and advancing and retracting the tool and guide. A three-point contact is established by the respective wheels 108 and the beveled leading edge of the tool.

Figure 12:
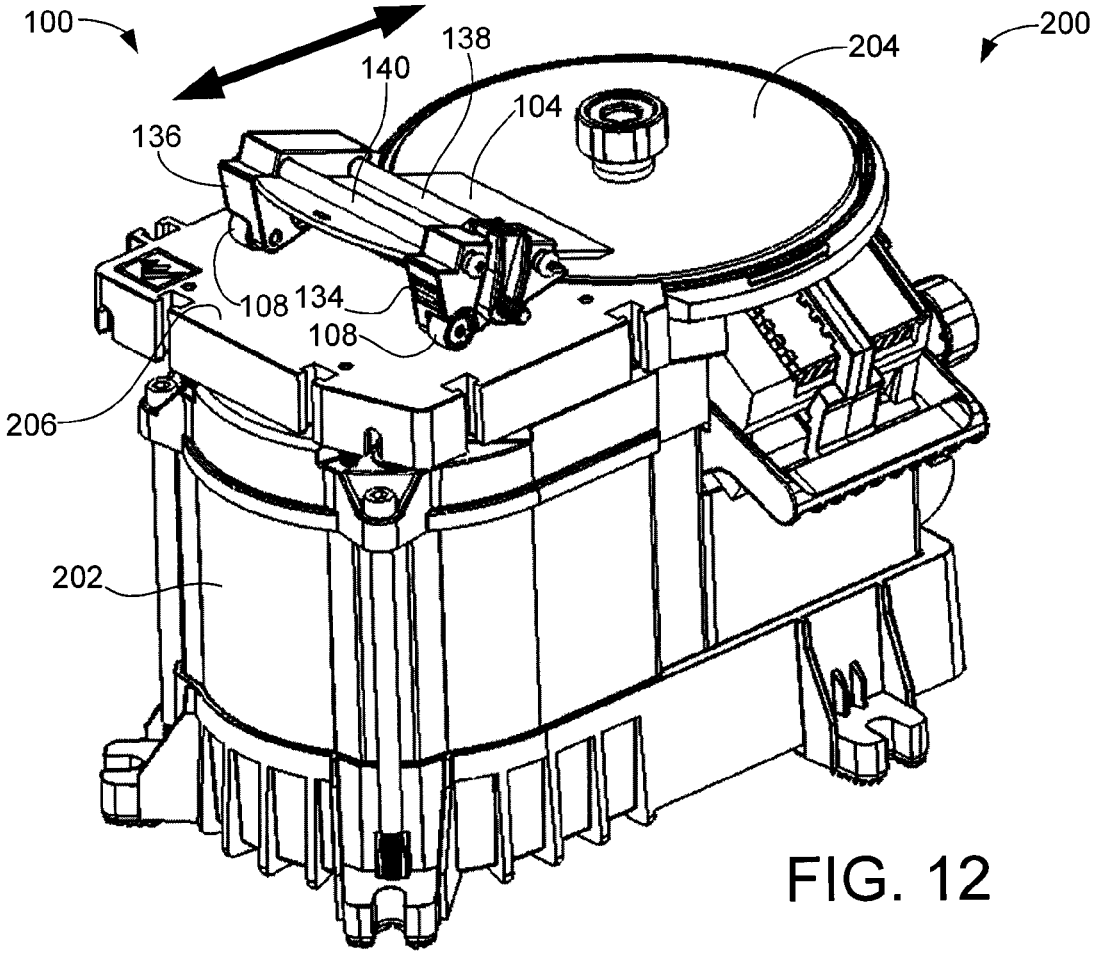
FIG. 12 shows an alternative methodology for sharpening a leading edge of a selected tool on a rotating abrasive surface.

FIG. 12 shows the use of a sharpening assembly 200 in conjunction with the guide 100. The sharpening assembly 200 utilizes a motor (not shown) within a housing 202 to controllably rotate an abrasive disc 204 at a selected rotational rate. A table structure 206 is preferably provided adjacent the disc 204 to provide a surface along which the guide 100 can be rolled to advance and retract the tool 104 against the disc 204. Preferably, the table surface is nominally at the same elevational height as the disc 204 in order to maintain the desired geometries during the sharpening operation. Any number of other moveable or stationary abrasive surfaces can be provisioned for use with the guide 100.

As those skilled in the art will appreciate, the sharpening of the beveled leading edge in a manner such as illustrated in FIGS. 11-12 can result in accumulation of removed material (e.g., a burr) that extends from the cutting edge. Accordingly, in a preferred sharpening sequence, the beveled leading edge and the back surface are alternately presented for sharpening against the associated abrasive surface while maintaining the guide in the inverted orientation.

Figure 13:
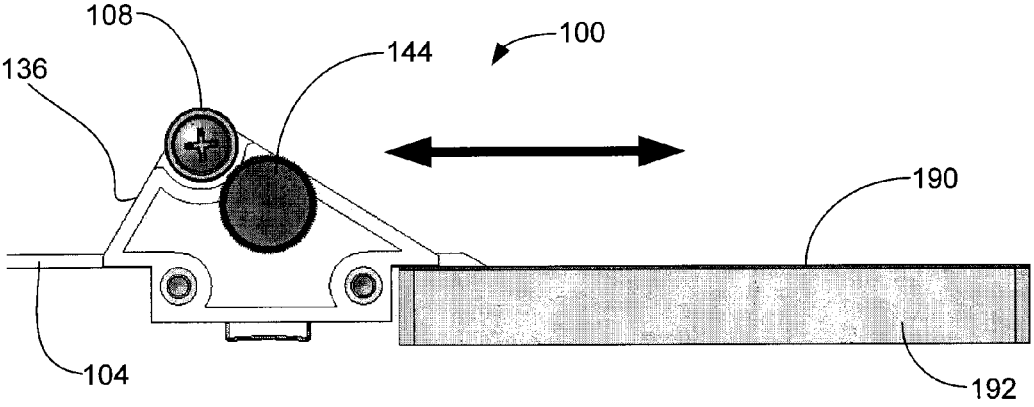
FIG. 13 illustrates a methodology for honing a backplane of the tool on the stationary abrasive surface.

With respect to the use of the stationary abrasive layer 190 in FIG. 11, after a relatively small number of forward and backward cycles (e.g., 5-6), the guide 100 and associated tool are inverted as shown in FIG. 13 so that the bottom surface of the tool can be brought into flat contact with the abrasive layer 190. As before, light pressure is applied by the user while moving the guide and the tool forward and backward (or side to side) as shown to hone the back surface and remove such burred material from the cutting edge.

Figure 14:
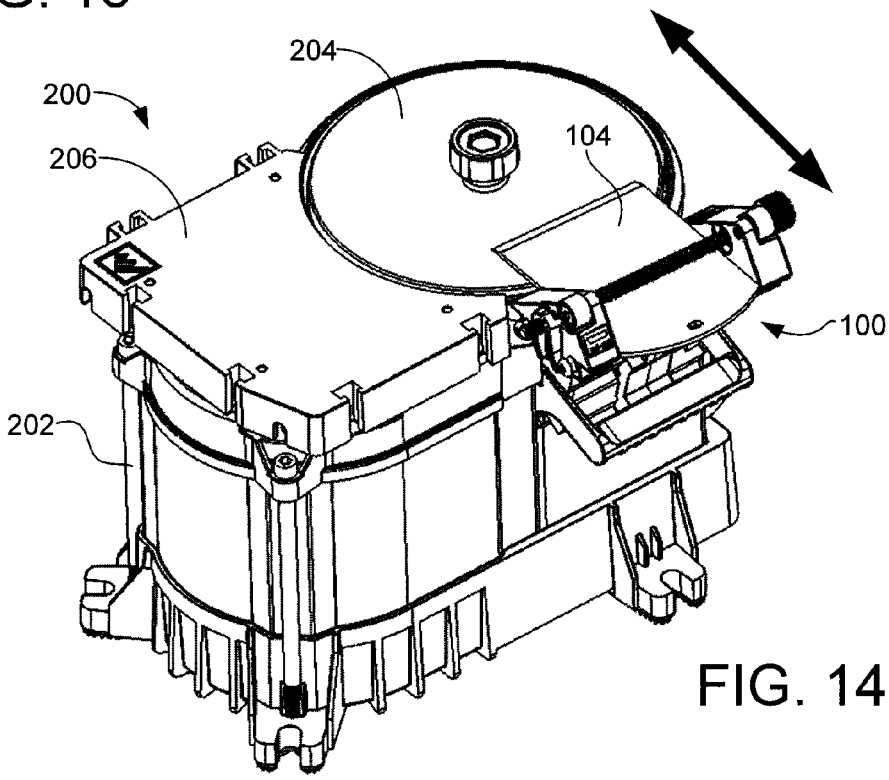
FIG. 14 illustrates an alternative methodology for honing the backplane of the tool on the rotating abrasive surface.

The skilled artisan will appreciate that it may not be necessarily required to advance and retract the guide and tool when a moveable abrasive is utilized such as with the sharpening assembly 200 of FIG. 14, since a sharpening operation will take place as a result of the abrasive medium moving adjacent the stationary tool. Nevertheless, forward and backward movement of the guide and tool in FIG. 14 is preferably employed to further ensure uniformity of the sharpening process.

As before, after a relatively short period of grinding with the tool 104 and guide 100 oriented as shown in FIG. 12, the guide is inverted as shown in FIG. 14 to present the bottom surface against the abrasive disc 204 to carry out a corresponding honing operation thereon. It is contemplated that a relatively small number of sharpening/honing cycles, such as on the order of 3-5 or more, may be sufficient to achieve the requisite sharpness for a given tool. A variety of factors, including the material composition and condition of the tool, as well as any desired changes in tool geometry (such as the implementation of a different bevel angle), may require the use of a significantly greater number of additional cycles.

Different levels of abrasiveness of the various abrasive layers may further be desired; for example, a relatively coarse grit (e.g., 120 grit, etc.) may be initially used to remove relatively large amounts of material from the tool, followed by one or more finer grits (e.g., 400, 1200, etc.) to successively provide finer sharpening of the respective surfaces.

Figure 15:
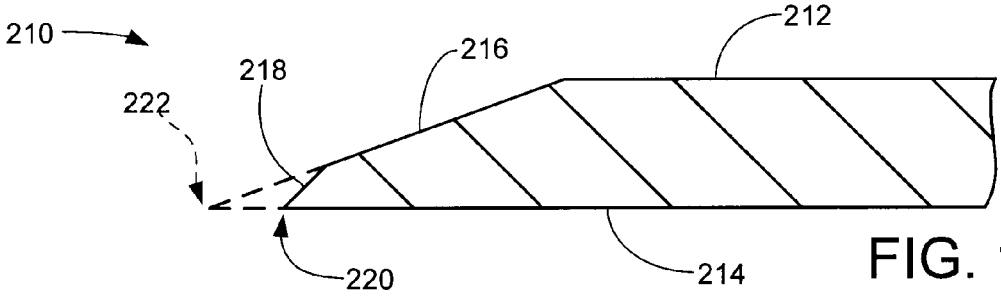
FIG. 15 shows a cross-sectional view of another tool with multiple beveled leading edge surfaces obtained using the guide and alignment assembly.

It may be desirable to provide a tool with multiple beveled lead edge surfaces at different angles, such as exemplified by another tool 210 in FIG. 15. The tool 210 is shown in cross-section for clarity of illustration, and may correspond to a chisel such as 102, a plane such as 104, or some other style of cutting tool. The tool 210 includes opposing top and bottom surfaces 212, 214, and first and second beveled leading edge surfaces 216, 218. The first leading edge surface 216 extends at a first angle, such as about 25°. The second leading edge surface 218 has a greater second angle, such as about 45°, and meets the bottom surface 214 to form a cutting edge 220. The use of the second leading edge surface 218 generally provides a stronger cutting edge 220 as compared to a cutting edge 222 (shown in broken line fashion) formed using a lower angle, and therefore may provide different cutting characteristics and greater wear resistance.

The tool 210 can be provisioned with the characteristics shown in FIG. 15 by providing a first sharpening sequence whereby the tool 210 is aligned in the alignment assembly 150 to provide a bevel angle of 25°, followed by sharpening/honing operations such as shown by FIGS. 11 and 13 or FIGS. 12 and 14. This forms the first leading edge surface 216 and the first cutting edge surface 222.

The tool 210 is then be reinserted into the guide 100 and realigned with the alignment assembly 150 for the second bevel angle of 45°, after which the sharpening/honing operations are repeated with this new setting. This results in the removal of the material bounded by the broken lines in FIG. 15 and formation of the second beveled leading edge surface 218 and final cutting edge surface 220. It will be appreciated that multiple abrasive levels can be utilized during either or both of these respective sharpening sequences. In a preferred embodiment, a relatively coarse grit is used for the first sequence, followed by the use of a relatively fine grit for the second sequence.

Figure 16:
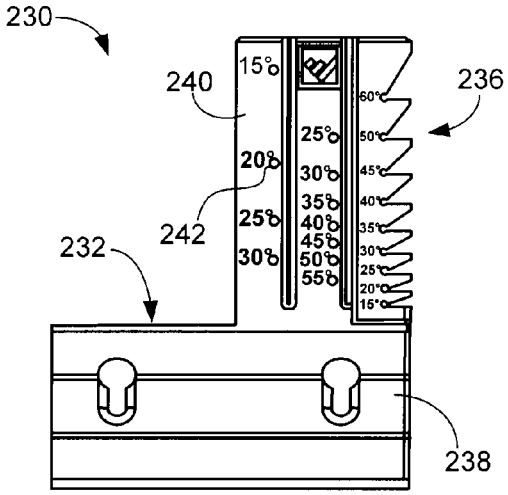
FIG. 16 sets forth an alternative embodiment for the alignment assembly.
Figure 16A:
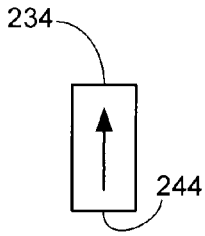
FIGS. 16A and 16B provide respective views of the alignment pin of FIG. 16.

FIG. 16 shows an alternative alignment assembly 230 generally similar to the alignment assembly 150 set forth above. The alignment assembly 230 includes an L-shaped alignment plate 232, and a rectangular alignment pin 234 (FIG. 16A). As before, the plate 232 includes a number of slots 236 that serve as an angle finder, a base portion 238 to nestingly receive the guide 100 (see FIGS. 17A-B) and an extension portion 240 with a plurality of alignment apertures 242 to receive the alignment pin 234.

Figure 16B:
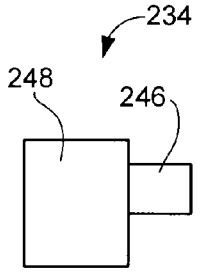
Figure 17A:
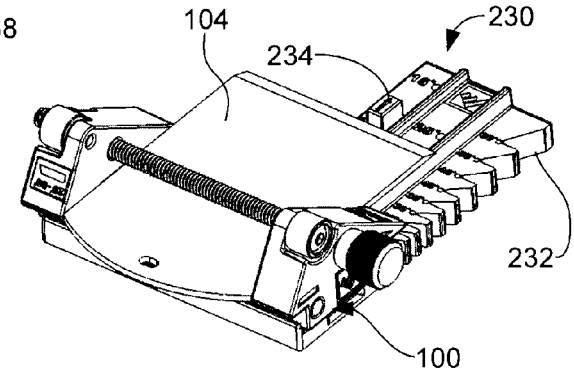
FIGS. 17A and 17B show respective isometric views of the alignment assembly of FIG. 16 in conjunction with the guide and a selected tool.
Figure 17B:
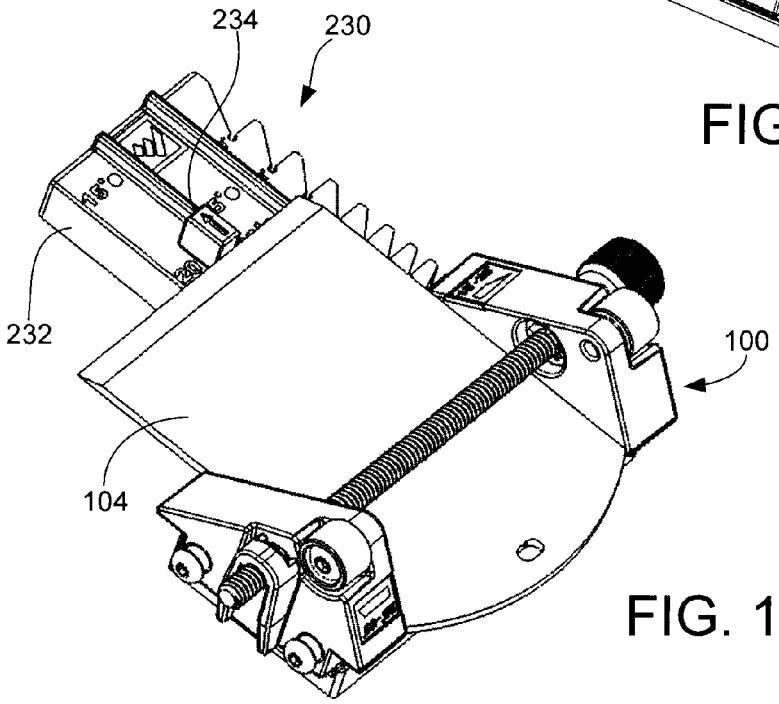

As shown in FIG. 16A, in some embodiments the alignment pin 234 only utilizes a single abutment surface 244 against which an associated tool is brought into contact, such as shown for the tool 104 in FIGS. 17A-B. In other embodiments, however, the alignment pin 234 can utilize a peg 246 that is offset with respect to a body portion 248 thereof, as generally represented in FIG. 16B, in which case incremental positive or negative adjustments to the bevel angle can be provided as set forth above.

Reference is now made to FIGS. 18-24, which generally illustrate the ability of the guide 100 to accommodate a wide variety of tool lengths. In this context, "tool length" generally refers to a dimension of the tool normal to the cutting edge (for example, with respect to the chisel 102 in FIG. 2, the distance from the cutting edge 120 to the distal end of the handle 110).

Figure 18:
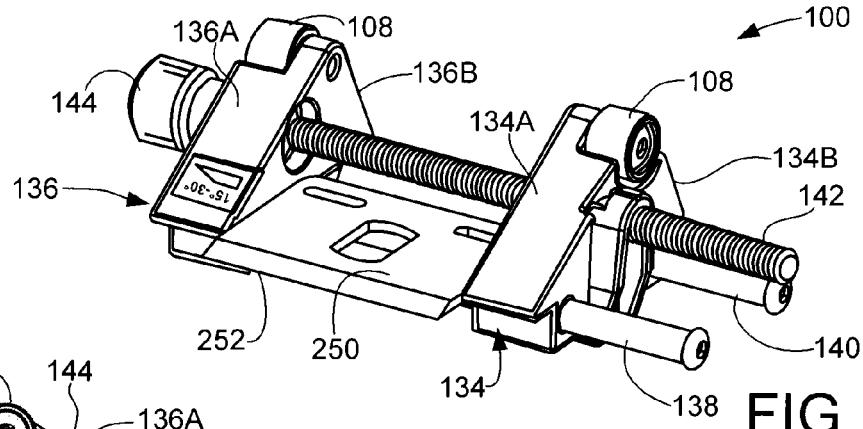
FIG. 18 shows the guide in conjunction with another, relatively short tool

FIG. 18 shows the guide 100 with a relatively short bladed tool 250 installed therein so as to be clamped between the respective body portions 134, 136. It is noted that the respective body portions 134, 136 are substantially triangular in shape, each with a so-called long surface 134A, 136A and a so-called short surface 134B, 136B.

For reference, the side of the guide 100 adjacent the long surfaces 134A, 136A is generally referred to herein as the "long side," and the other side of the guide 100 adjacent the short surfaces 134B, 136B is generally referred to herein as the "short side." It will be noted that the short bladed tool 250 is installed in FIG. 18 so as to extend from the long side of the guide 100, although such is not limiting.

Figure 19:
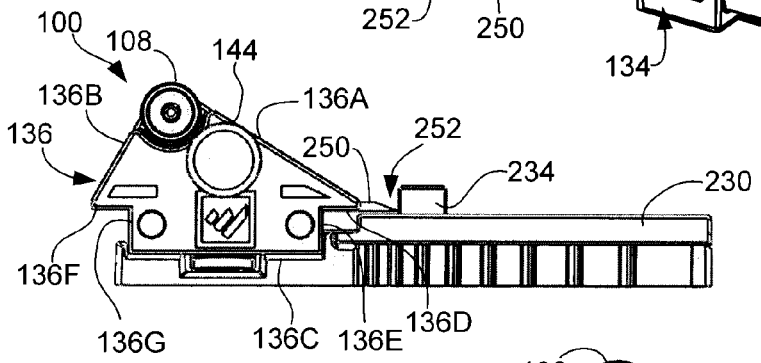
FIG. 19 shows an alignment of the tool and guide of FIG. 18, with the tool extending from a long side of the guide.

FIG. 19 shows a side elevational view of the guide/tool arrangement of FIG. 18 in conjunction with the alignment plate 230 of FIG. 16. A cutting edge 252 of the tool 250 is brought into contacting abutment with the alignment pin 234 of FIG. 17 to align the tool 250 for a selected angle (in this case, a bevel angle of 30 degrees).

It will be noted that the respective profiles of the body portions 134, 136 are substantially identical and take what can be referred to as an asymmetric arrow-head configuration. The respective angled surfaces 136A, 136B are substantially normal one to the other (i.e., about 90 degrees apart), although other configurations can be used in other embodiments.

A base surface is denoted at 136C, and long and short side shoulders, or notches, are formed by respective shoulder surfaces 136D/136E and 136F/136G. For reference, similarly identified features are denoted on the other body portion 134 in other figures in which the other body portion 134 is visible, such as in FIG. 20. As explained below, the notches are nominally symmetric and provide clearance during back side honing operations.

Figure 20:
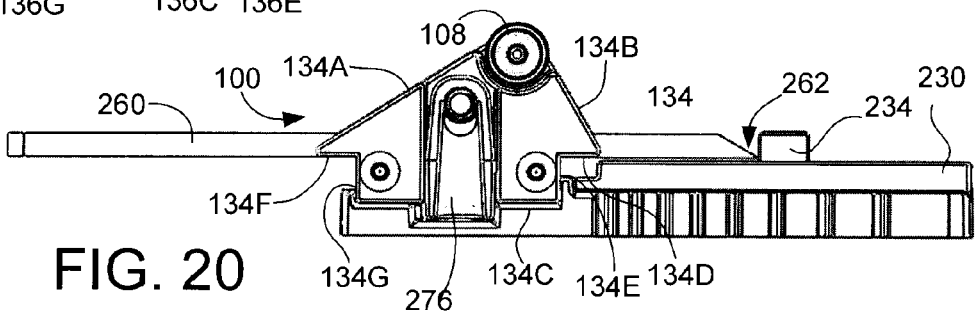
FIG. 20 shows a corresponding alignment of a relatively long tool in the guide, with the long tool extending from an opposing short side of the guide, and with the alignments of both FIGS. 19 and 20 to the same bevel angle.

FIG. 20 shows the guide 100 with a relatively long tool 260 installed therein so as to project from the short side of the guide 100. As in FIG. 19, the guide 100 and tool 260 are mated with the alignment plate 230 of FIG. 16, so that a distal cutting edge 262 of the long tool 260 contactingly engages the alignment pin 234. As in FIG. 19, the tool 260 in FIG. 20 is also set to establish a selected bevel angle of 30 degrees.

At this point, reference is again made to the alignment plates 150, 230 of FIGS. 5 and 16. It can be seen that each plate includes two separate sets of pin apertures (178 and 242), with a first set of apertures arranged along the left side of the associated plate 150, 230 and a second set of apertures arranged along the right side of the associated plate. The left-side apertures are utilized to set the bevel angle when the tool extends from the long side of the guide 100 (see e.g., FIG. 19), and the right-side apertures are utilized to set the bevel angle when the tool extends from the short side of the guide 100 (see e.g., FIG. 20).

This provides a number of benefits, including the ability to have sufficient distance to clamp and align a relatively short tool, such as the tool 250. It will be noted, for example, that there may not be sufficient tool length distance to clamp and align the short tool 250 to a bevel angle of 30 degrees if the short tool 250 is made to extend from the short side of the guide 100. Generally, the guide 100 as embodied herein can accommodate substantially short tool lengths, such as down to about 1½ inches. There is generally no upper maximum limit on tool length.

Figure 21:
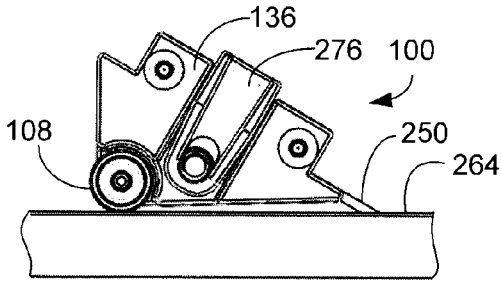
FIG. 21 sets forth a sharpening operation upon the aligned tool and guide of FIG. 19.
Figure 22:
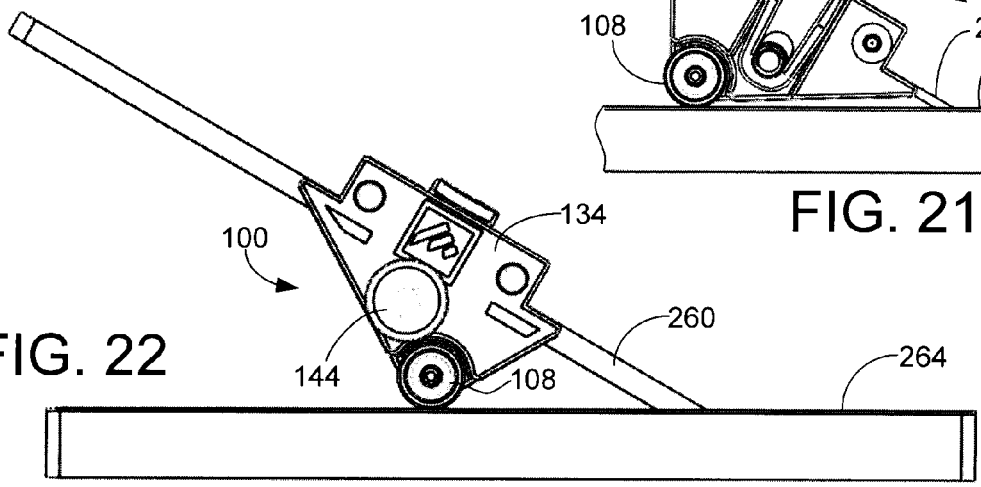
FIG. 22 sets forth a sharpening operation upon the aligned tool and guide of FIG. 20.

FIGS. 21-22 respectively show preferred sharpening operations on the tools 250, 260 on an associated abrasive surface 264. The wheels 108 allow the aforementioned reciprocal movement of the guide 100 with respect to the abrasive surface 264, and the angular orientation of the guide 100 with respect to the abrasive surface 264 will be maintained to present the tool at the desired bevel angle.

Figure 23:
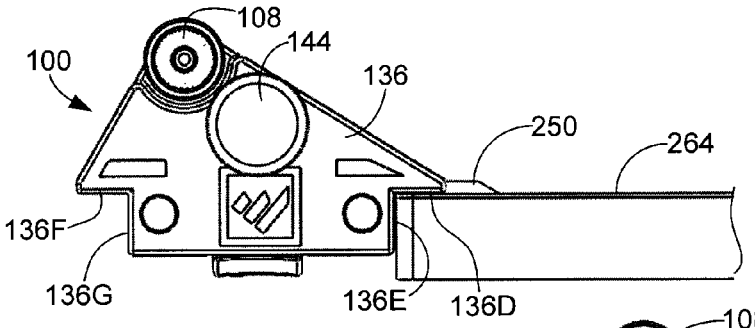
FIG. 23 shows a honing operation upon the aligned tool and guide of FIG. 21.
Figure 24:
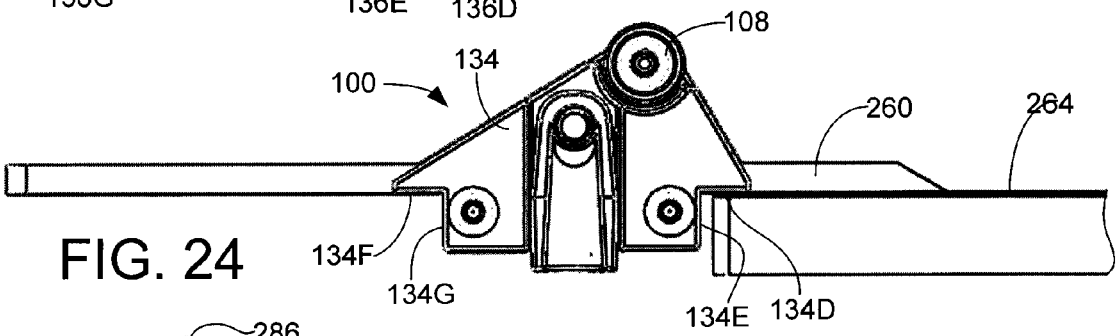
FIG. 24 shows a honing operation upon the aligned tool and guide of FIG. 22.

FIGS. 23-24 respectively show corresponding back-side honing operations on the tools 250, 260. The notches in the respective body portions 134, 136 provide clearance to facilitate maximum exposure of the associated back-sides of the tools 250, 260 to the abrasive surface 264. Specifically, the relative elevation of the shoulder surfaces 134D/134F and 136D/136F are set so as to not mechanically interfere (contact) the abrasive surface. This is achieved by setting the elevations of the shoulder surfaces to be "lower" than the elevational height of the reference surfaces provided by the rails when the guide is inverted.

The back side of a given tool can thus be honed all the way back to the respective surfaces 134E/134G and 136E/136G; that is, that portion of the backside between the respective body portions (forward extending ends adjacent 134D/134F and 136D/136F) can be honed because the forward extending ends will not mechanically interfere with the abrasive surface. This can be particularly important during the sharpening of short tools with very little stickout from the end of the guide.

Figure 25:
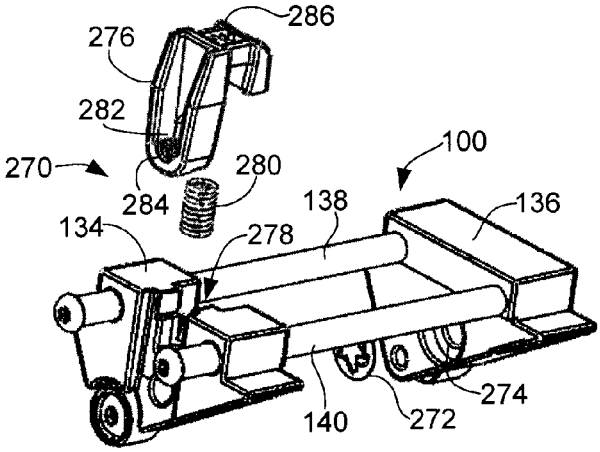
FIG. 25 is an exploded view of a quick-release attachment assembly of the guide.

FIG. 25 provides an exploded view of the guide 100 to illustrate preferred quick-release clamping features of the guide. It will be recalled that the body portion 134 is advanced or retracted with respect to the body portion 136 via a worm gear arrangement established by the threaded shaft 142 and user activated knob 144. While this arrangement can be fixed, such as in a conventional vise so that the body portion 134 remains permanently engaged with the threads of shaft 142, in preferred embodiments a spring biased release assembly 270 is used to allow the body 134 to be quickly and easily advanced along the shaft 142. This can be useful, for example, when a relatively wide (or narrow) tool is presented for sharpening via the guide 100, and the user desires to quickly open (or close) the width of the body portions 134, 136 to conform to the width of the tool.

The release assembly 270 generally includes a locking member, such as a spring nut 272, to capture a base of the shaft 142 adjacent the knob 144 to the body portion 136. The shaft 142 is inserted through an unthreaded aperture 274 in the body portion 136, and the spring nut 272 engages the shaft 142 on a side of the body portion 136 opposite the knob 144 to retain the knob 144 adjacent the body portion 136.

Figure 25A:
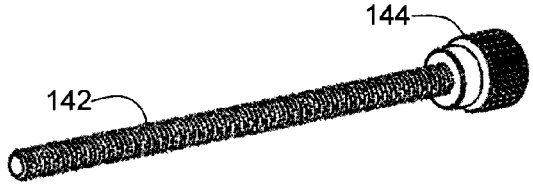
FIG. 25A is an elevational depiction of a release member of FIG. 25.
Figure 25A:
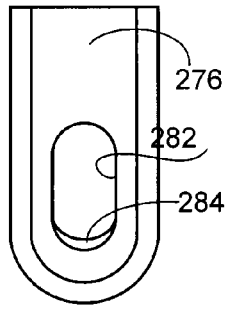
Figure 26:
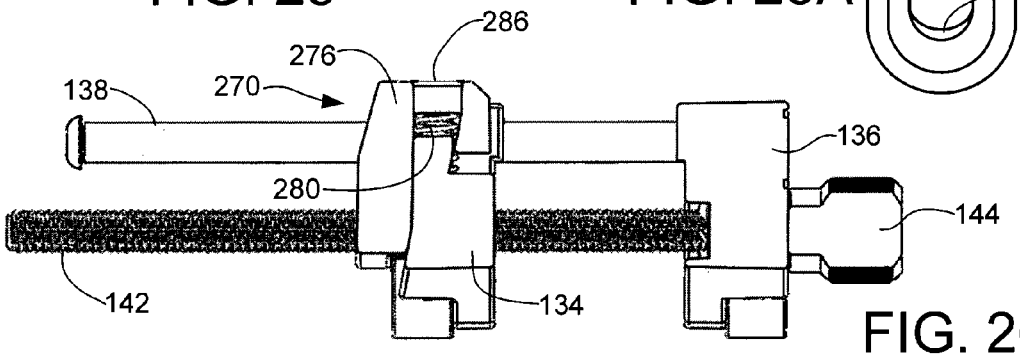
FIG. 26 is a side elevational view of the guide to further illustrate the quick-release attachment assembly.

A deflectable release member 276 is retained in a channel 278 of the body portion 134, and an upwardly directed bias force (as oriented in FIG. 25) is placed upon the release member 276 by a biasing member 280 (in this case, a coiled spring). The release member 276 includes an elongated, half-nut aperture 282, as generally denoted in FIG. 25A, with a threaded portion 284 along a bottom surface of the aperture 282. An upper portion of the aperture 282 remains unthreaded and sized to allow the shaft 242 to pass freely therethrough.

The bias force provided by the biasing member 280 normally retains engagement of the threads of the shaft 242 with the threads 284 in the aperture 282. In this way, during normal operation, rotation of the shaft 242 via knob 244 induces the aforedescribed worm gear linear advancement of the body portion 134 with respect to the body portion 136. However, when the user presses downwardly upon the release member 276 via press surface 286 (FIG. 25), the threads 284 are disengaged from threads of shaft 242, and the body portion 134 can be freely advanced along the length of the shaft 242.

Preferably, the release member 276 and channel 278 are canted with respect to the threads of the shaft 142 so that the release member 276 does not disengage when a clamping force is placed onto a tool. That is, any attempt by the release member 276 to disengage from the shaft 142 during tightening upon a tool will induce inward movement of the body portion 134 toward the body portion 136, and the clamped tool will prevent such inward movement as a result of mechanical interference. Hence, once a tool has been tightly clamped between the body portions 134, 136, it may be necessary for the user to first release the clamped pressure by rotating the knob 144 and advancing the body portion 134 away from the tool a slight distance before the release member 276 can be depressed.

It will be appreciated that the various embodiments set forth herein provide advantages over the prior art. The guide as exemplified at 100 provides an easy to use, accurate and repeatable mounting mechanism for any number of tools, particularly those characterized as having relatively wide blade widths. The alignment assembly such as exemplified at 150 and 230 enables a given tool to be accurately placed within the guide for any number of different sharpening geometries.

Any number of different styles of abrasive surfaces, including stationary blocks, grinding/whet stones, grinding wheels, abrasive discs, belts, abrasive sandpaper affixed to a flat glass block, etc. can be utilized with the sharpening guide, alone or in combination, to effect extremely sharp cutting surfaces, approaching or exceeding razor sharpness. Multiple and/or successively finer grits of abrasiveness can further be utilized as desired, depending on the requirements of a given application.

Moreover, while side-clamping is preferably used to clamp the tool within the guide, it will be appreciated that other clamping orientations, such as clamping of the top and bottom surfaces of the tool, can be alternatively or additionally provided.

For purposes of the appended claims, the term "acute angle" and the like will be understood consistent with the foregoing description as an angle of less than 90 degrees. The term "honing" and the like requires concurrent contact by the abrasive surface along the entire width of the back side of the tool (from side to side) as opposed to just a portion of the width of the back side to ensure flatness of this back side.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. An apparatus for sharpening a tool having a back surface, opposing side surfaces and a beveled leading edge surface which adjoins the back surface at an acute angle to form a cutting edge, the apparatus comprising:

a sharpening guide comprising:

opposing first and second body portions configured to contactingly apply a clamping force to the respective side surfaces of the tool to secure the tool to the guide, wherein the guide is configured to present the beveled leading edge surface of the secured tool adjacent an abrasive surface to sharpen the cutting edge while the guide is in an upright orientation, and to present the back side of the secured tool against the abrasive surface to hone a portion of the back surface disposed between the first and second body portions while the guide is in an inverted orientation opposite the upright orientation; and an alignment plate configured to align the tool within the guide prior to application of said clamping force, the plate configured to nestingly secure the guide to the plate while the guide is placed in the inverted orientation and the tool is advanced through the inverted guide so that the back surface slides adjacent an upper plate surface and the cutting edge contactingly abuts an alignment feature which projects from the plate surface, and wherein the guide and the plate are configured such that the clamping force is subsequently applied while said contacting abutment between the cutting edge and the alignment feature is maintained.

2. The apparatus of claim 1, wherein the first and second body portions respectively comprise first and second forward extending clamp portions which contactingly engage the respective edge surfaces of the tool and first and second recessed shoulder surfaces which extend from the respective first and second forward extending clamp portions to form opposing first and second clearance notches, and wherein the clearance notches facilitate honing upon said portion of the back surface between the first and second forward extending clamp portions.

3. The apparatus of claim 1, wherein the alignment plate comprises a plurality of spaced apart apertures which extend into the upper plate surface, wherein the alignment feature comprises an alignment pin with a body portion and a peg extension, the peg extension configured for insertion into each of the apertures in turn to establish different overall projection distances of the beveled leading edge surface from the guide to provide different final bevel angles for the sharpened tool.

4. The apparatus of claim 3, wherein the body portion of the alignment pin comprises at least two opposing, outwardly facing contact surfaces each a different respective distance from a central axis of the peg extension to provide at least two different selectable bevel angles for the sharpened tool when the alignment pin is placed in each of the apertures in the alignment plate.

5. The apparatus of claim 3, wherein the alignment plate further comprises a plurality of angle finder slots configured to receivingly nest the beveled leading edge surface of the tool to identify a nominal angle of said beveled leading edge surface, and wherein human readable indicia are present on the plate to associate each of the angle finder slots with a corresponding one of the plurality of apertures.

6. The apparatus of claim 1, further comprising a first wheel connected to the first body portion and a second wheel connected to the second body portion, wherein the first and second wheels are configured to contactingly roll along the abrasive surface during said sharpening of the cutting edge.

7. The apparatus of claim 1, wherein the sharpening guide further comprises a reference surface which abuttingly contacts the back surface of the tool prior to and during application of said clamping force, the reference surface comprising an outer surface of a laterally extending rail along which the opposing first and second body portions slidingly advance to contactingly engage the respective opposing side surfaces to establish the clamping force upon the tool.

8. The apparatus of claim 7, wherein the rail is characterized as a first rail, wherein the guide further comprises a second rail nominally identical and spaced apart from the first rail, and wherein the second rail provides a second reference surface against which the tool contactingly rests during the application of the clamping force.

9. The apparatus of claim 1, wherein the guide comprises a threaded shaft with a user activated knob, wherein the threaded shaft threadingly engages a selected one of the first or second body portion to laterally move said selected one of the body portions to establish the clamping force.

10. The apparatus of claim 9, wherein the selected one of the first or second body portions further comprises a quick disconnect assembly comprising an engagement member which threadingly engages the threaded shaft, wherein the engagement member is configured to be depressed by a user to disengage the engagement member from the threaded shaft and slidingly advance the selected one of the first or second body portions along the threaded shaft.

11. The apparatus of claim 10, wherein the engagement member is characterized as a release member with an elongated half-nut aperture having a set of partial threads along a first side thereof, and a biasing member which normally biases the release member so that the set of partial threads engages a selectively rotatable threaded shaft which extends between the first and second body portions, the release member further comprising a press surface which, when engaged by the user, overcomes said biasing of the biasing member and disengages said set of partial threads from the threaded shaft.

12. The apparatus of claim 1, wherein the first and second body portions each comprise a long side surface of a first length and a short side surface of a second length shorter than the first length, wherein a selected tool can be alternately installed between the first and second body portions so that a cutting surface thereof extends from the guide adjacent the respective long side surfaces or the respective short side surfaces.

13. The apparatus of claim 1, wherein the first and second body portions each comprise first, second and third outer surfaces to form a substantially triangular shape, wherein a wheel is supported by each of the first and second body portions at a juncture between the first and second surfaces, the first and second surfaces forming an angle of substantially 90 degrees at said juncture, and wherein the second surface is longer than the first surface and shorter than the third surface to provide an asymmetric shape that facilitates relatively longer tools to be secured adjacent and between the shorter first surfaces so as to project out a first end of the guide and relatively shorter tools to be secured adjacent and between the longer first surfaces so as to project out an opposing second end of the guide.

14. A method for sharpening a tool having a back surface, opposing side surfaces and a beveled leading edge surface which adjoins the back surface at an acute angle to form a cutting edge, the method comprising:

placing a sharpening guide onto an alignment plate so that the alignment plate supports the sharpening guide in an inverted orientation;

inserting the cutting tool through the sharpening guide so that the back surface is oriented in facing relation to an upper plate surface and the cutting edge contactingly abuts an alignment feature which projects from the plate surface;

securing the tool to the sharpening guide by advancing opposing first and second body portions of the sharpening guide to contactingly apply a clamping force to the respective opposing side surfaces of the tool;

removing the sharpening guide and the secured cutting tool from the alignment plate; and presenting the beveled leading edge surface of the secured tool adjacent an abrasive surface to sharpen the cutting edge while the guide is in an upright orientation.

15. The method of claim 14, wherein the first and second body portions respectively comprise first and second forward extending clamp portions which contactingly engage the respective edge surfaces of the tool during the securing step, and wherein the first and second body portions further respectively comprise first and second recessed shoulder surfaces which extend from the respective first and second forward extending clamp portions to form opposing first and second clearance notches, the clearance notches facilitating the honing of said portion of the back surface between the first and second forward extending clamp portions during the presenting the back side of the secured tool step.

16. The method of claim 14, wherein the first and second body portions each comprise a long side surface of a first length and a short side surface of a second length shorter than the first length, wherein the securing and the respective presenting steps are carried out on a first tool of a first overall length while the first tool is secured between and adjacent the respective short side surfaces so that the cutting edge of the first tool projects from a first end of the guide, and wherein the securing and the respective presenting steps are subsequently carried out on a second tool having a second overall length less than the first overall length while the second tool is secured between and adjacent the respective long side surfaces so that the cutting edge of the second tool projects from an opposing second end of the guide.

17. The method of claim 14, further comprising:

presenting the back side of the secured tool against the abrasive surface to hone a portion of the back surface disposed between the first and second body portions while the guide is in an inverted orientation opposite the upright orientation.

18. The method of claim 14, wherein the alignment plate comprises a plurality of spaced apart apertures which extend into the upper plate surface, wherein the alignment feature comprises an alignment pin with a body portion and a peg extension, and wherein the inserting step further comprises placing the peg extension into a selected aperture of the plate to establish a selected overall projection distance of the beveled leading edge surface from the guide.

19. The method of claim 18, wherein the body portion of the alignment pin comprises at least two opposing, outwardly facing contact surfaces each a different respective distance from a central axis of the peg extension to provide at least two different selectable bevel angles for the sharpened tool when the alignment pin is placed in each of the apertures in the alignment plate in turn, and wherein the inserting step further comprises rotating the alignment pin to bring a selected one of the at least two opposing, outwardly facing contact surfaces into facing arrangement with the beveled surface.

20. A sharpening guide for sharpening a tool, comprising:

opposing first and second body portions configured to contactingly apply a clamping force to opposing side surfaces of the tool to secure the tool to the guide;

a threaded shaft with a user activated knob, wherein the threaded shaft threadingly engages a selected one of the first or second body portion to laterally move said selected one of the body portions to establish the clamping force; and a quick disconnect assembly comprising an engagement member which threadingly engages the threaded shaft, wherein the engagement member is configured to be depressed by a user to disengage the engagement member from the threaded shaft and slidingly advance the selected one of the first or second body portions along the threaded shaft.

21. The sharpening guide of claim 20, wherein the guide is configured to present a beveled leading edge surface of the secured tool adjacent an abrasive surface to sharpen the cutting edge while the guide is in an upright orientation, and to present the back side of the secured tool against the abrasive surface to hone a portion of the back surface disposed between the first and second body portions while the guide is in an inverted orientation opposite the upright orientation.

22. The sharpening guide of claim 20, wherein the engagement member is characterized as a release member with an elongated half-nut aperture having a set of partial threads along a first side thereof, and a biasing member which normally biases the release member so that the set of partial threads engages a selectively rotatable threaded shaft which extends between the first and second body portions, the release member further comprising a press surface which, when engaged by the user, overcomes said biasing of the biasing member and disengages said set of partial threads from the threaded shaft.

23. The sharpening guide of claim 20, in which the tool comprises a beveled leading edge surface between the respective opposing side surfaces which adjoins the back surface at an acute angle to form a cutting edge, and the sharpening guide facilitates sharpening of the cutting edge while the tool is secured therein.

24. A sharpening guide for sharpening a tool, comprising opposing first and second body portions configured to contactingly apply a clamping force to opposing side surfaces of the tool to secure the tool to the guide, wherein the first and second body portions each comprise first, second and third outer surfaces to form a substantially triangular shape, wherein a wheel is supported by each of the first and second body portions at a juncture between the first and second surfaces, the first and second surfaces forming an angle of substantially 90 degrees at said juncture, and wherein the second surface is longer than the first surface and shorter than the third surface to provide an asymmetric shape that facilitates relatively longer tools to be secured adjacent and between the shorter first surfaces so as to project out a first end of the guide and relatively shorter tools to be secured adjacent and between the longer first surfaces so as to project out an opposing second end of the guide.

25. The sharpening guide of claim 24, further comprising a reference surface which abuttingly contacts a back surface of the tool prior to and during application of said clamping force, the reference surface comprising an outer surface of a laterally extending rail along which the opposing first and second body portions slidingly advance to contactingly engage the respective opposing side surfaces to establish the clamping force upon the tool.

26. The sharpening guide of claim 24, wherein the rail is characterized as a first rail, wherein the guide further comprises a second rail nominally identical and spaced apart from the first rail, and wherein the second rail provides a second reference surface against which the tool contactingly rests during the application of the clamping force.

27. The sharpening guide of claim 24, further comprising a threaded shaft with a user activated knob, wherein the threaded shaft threadingly engages a selected one of the first or second body portion to laterally move said selected one of the body portions to establish the clamping force.

28. The sharpening guide of claim 27, further comprising a quick disconnect assembly comprising an engagement member which threadingly engages the threaded shaft, wherein the engagement member is configured to be depressed by a user to disengage the engagement member from the threaded shaft and slidingly advance the selected one of the first or second body portions along the threaded shaft.

29. The sharpening guide of claim 24, in combination with a powered sharpener assembly comprising a rotatable abrasive surface adjacent a stationary table surface adapted to support the sharpening guide during presentation of the tool against the rotatable abrasive surface.

* * * * *